US007935224B2

(12) United States Patent
Videgren

(10) Patent No.: US 7,935,224 B2
(45) Date of Patent: May 3, 2011

(54) UNIT IN A FORMING SECTION OF A PAPERMAKING MACHINE

(75) Inventor: Leif Videgren, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 144 days.

(21) Appl. No.: 12/375,358

(22) PCT Filed: Aug. 10, 2006

(86) PCT No.: PCT/SE2006/000940

§ 371 (c)(1),
(2), (4) Date: Feb. 25, 2009

(87) PCT Pub. No.: WO2008/018819

PCT Pub. Date: Feb. 14, 2008

(65) Prior Publication Data

US 2009/0301678 A1 Dec. 10, 2009

(51) Int. Cl.
*D21F 1/32* (2006.01)

(52) U.S. Cl. ..... 162/275; 162/315; 29/428

(58) Field of Classification Search ..... 162/275, 162/315, 190; 29/428
See application file for complete search history.

(56) References Cited

U.S. PATENT DOCUMENTS

| | | | | |
|---|---|---|---|---|
| 3,056,719 | A | 10/1962 | Webster | |
| 4,153,504 | A | 5/1979 | Justus | |
| 5,141,600 | A | 8/1992 | Meinecke et al. | |
| 5,409,575 | A | 4/1995 | Savia et al. | |
| 5,582,688 | A | 12/1996 | Bando et al. | |
| 6,398,913 | B2 * | 6/2002 | Eriksson | 162/190 |
| 6,413,371 | B1 | 7/2002 | Ahonen et al. | |
| 2001/0018958 | A1 * | 9/2001 | Eriksson | 162/190 |

* cited by examiner

*Primary Examiner* — Mark Halpern
(74) *Attorney, Agent, or Firm* — Alston & Bird LLP

(57) ABSTRACT

The invention discloses a pre-assembled self-supporting unit (1) for a twine wire forming section. The unit comprises an integrated save-all tray (25) and other integrated elements such as cross walkway (17), piping beam (10), connecting arms (8). The rolls (2) for supporting at least one forming clothing loop (4) and the other elements are mounted onto this separate unit instead of being mounted onto the same machine frame. The unit provides a diminished foot print for the forming section, and it is dimensioned to fit in a standard transport container.

25 Claims, 8 Drawing Sheets

UNIT IN A FORMING SECTION OF A PAPERMAKING MACHINE

Figure 1:
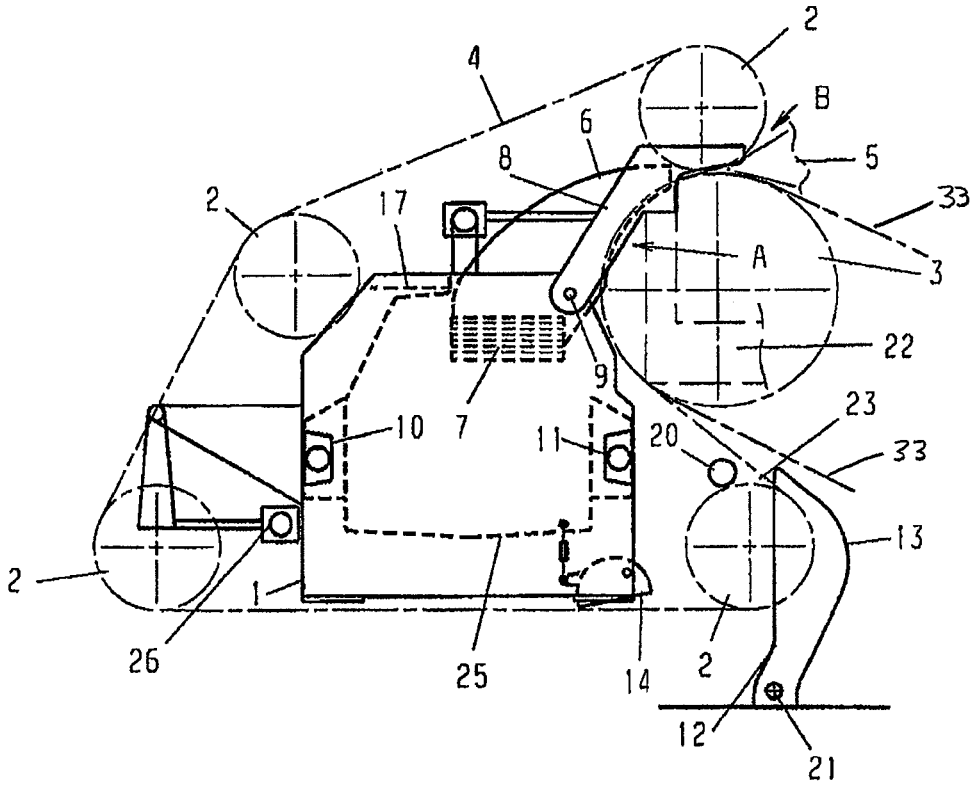

This application is a 371 of PCT/SE06/00940 filed on 10 Aug. 2006.

FIELD OF THE INVENTION

The present invention relates to a new compact unit in a forming section of a papermaking machine, more precisely to a self-supporting pre-assembled compact unit having an integrated save-all tray. The rolls supporting an outer and/or an inner forming wires are mounted onto the unit.

BACKGROUND OF THE INVENTION

A forming section in a conventional papermaking machine having, for example C-former and Crescent-former, usually comprises two loops of an industrial clothing running about a plurality of lead- and guide rolls, and a paper stock is delivered between these clothing by a headbox for forming a paper web therebetween. One loop of the clothing forms an outer wire loop while the second loop forms an inner wire loop. The paper stock is partly dewatered in the forming section, and water is drained through the wire and collected by a save-all tray situated under the wire. The save-all tray is usually made of a sheet metal and extends over a length of the wire wherein the drainage of the water through the wire occurs. Usually the save-all tray is mounted onto a machine frame part in the forming section. Then the water evacuates from the save-all tray and from the forming section. These two loops of clothing in the forming section could comprise different kind of clothing such as wires or a combination of different kind of wires and/or fabrics, felts and/or belts suitable for the partial dewatering of the paper web in the forming section of the machine.

Usually the lead rolls, stretch rolls, guide rolls and other elements supporting the outer- and the inner clothing are also mounted on the machine frame as illustrated in U.S. Pat. No. 5,409,575 (Savia et al), FIG. 1. The frame is a rather heavy and complicated construction requiring a stable basement, as illustrated in U.S. Pat. No. 6,413,371 (Ahonen et al), comprising a lot of metal profiles and requiring many working man-hours to be erected. Only after the entire machine frame is erected on a prepared basement, it become possible to mount the big amount of different elements such as bearing houses, arms for supporting the rolls, the rolls of the forming section, different deflectors, the save-all tray for removing the drained water, carrying shafts, motors and other elements, and then to thread the machine clothing onto the rolls. Therefore, when the big amount of elements should be assembled to the frame, as illustrated also by U.S. Pat. No. 5,582,688 (Bando et al) the assembling of the forming section takes a longer time, and the assembling work is rather costly. The conventional forming section requires rather big internal space in order to provide an access to all places of the frame to which all the elements as described above are to be mounted. Therefore, the conventional forming section has a rather big foot print.

As the rolls for both, the inner- and the outer clothing are mounted on the same frame as well as a forming roll, which is rather massive element, and all these rotating at the very high speed elements cause the vibrations, this vibrations could be transferred through the frame and interfere the machine performance.

The object of the invention is to minimize or eliminate these mentioned disadvantages, which is achieved by a new compact unit in accordance with claim 1. Advantageous embodiments have the features stated in the dependent claims.

SUMMARY OF THE INVENTION

Contrary to the known paper machine layouts as described above, the forming section of the paper machine comprises a self-supporting pre-assembled compact unit according to the invention having an integrated save-all tray that defines the shape and dimensions of the unit. The rolls supporting of the outer forming wire and other required elements, for instance, such as the piping, walkways and the like, are mounted onto the self-supporting unit instead of being mounted to the entire machine frame as in the conventional paper machines. Thus, the self-supporting unit performs the function of a separate frame element for supporting the save-all tray and other elements when required. As the pre-assembled unit supporting the rotating rolls is separated from the entire machine frame, this design decreases the transfer of the vibrations created by the rotating rolls to the entire machine frame. When desired, in the alternative embodiments, the similar self-supporting unit with the integrated save-all tray might be provided for the mounting of the rolls supporting the inner forming clothing in the forming section of the paper machine or for both the inner- and the outer forming clothing.

The unit does not require a special basement for erecting and is dimensioned to fit into a standard transporting container. The unit is more maintenance friendly, provides easier wire change, decreases the erection time, decreases amount of walkways and other parts in the entire machine and thus decreases the material need, weight of the used material and costs as well as simplifies transportation of the machine to the site. The invention is applicable for any types of paper- or pulp making machines, such as paper-, newsprint-, board and tissue making machines. The unit in different modifications is adapted to different kinds of forming sections such as a C-former or a Crescent-former.

The unit according to the invention is to be used in the forming section, for instance, of a tissue-making paper machine, wherein the forming section comprises the inner- and the outer forming clothing. The clothing could be one of the forming fabric and a forming wire. The clothing is running about a number of rolls in endless loops and, when merging, form a forming zone between them situated about a forming roll. A headbox injects the paper stock between these two forming clothing in a forming gap. A paper web is being formed in the forming zone due to drainage of water through at least one of the clothing. The drained water is being evacuated by at least one tray from the forming section. The unit is a self-supporting unit and is arranged for supporting the tray and for the mounting the rolls supporting one of the forming clothing thereon.

The forming section in a paper machine comprises the inner clothing and the outer clothing, preferably forming wires, fabrics, felts or belts, each supported by a number of rolls and arranged in two endless loops forming, when merging, a forming zone therebetween. The headbox injects the paper stock between these two forming clothing, and a paper web is formed due to draining water through the at least one of the forming clothing or the forming wire in the forming zone about a forming roll. The forming roll is supported by a machine frame. The forming section for the paper machine according to the invention comprises at least one self-supporting unit with an integrated save-all tray; the unit supports the tray and acts as a separate frame element for supporting the integrated save-all tray and is made separate from the paper machine frame. The compact self-supporting unit is used for mounting of the rolls supporting the one of the forming wires thereon instead of mounting the rolls to the entire machine frame.

The unit may have a second tray for evacuation the drained water from the forming zone into the save-all tray that evacuates the water away from the forming section.

A method of assembling the forming section having a compact self-supporting forming unit according to the invention is comprises steps of mounting the unit on a floor, mounting the clothing supporting rolls and the arms onto the unit having pre-assembled piping beams and a cross walkway, threading the clothing onto the rolls, adjusting the rolls positions by the retraction device and rotating the arms so that to connect them to the rest of machine frame during the machine performance.

Figure 2:
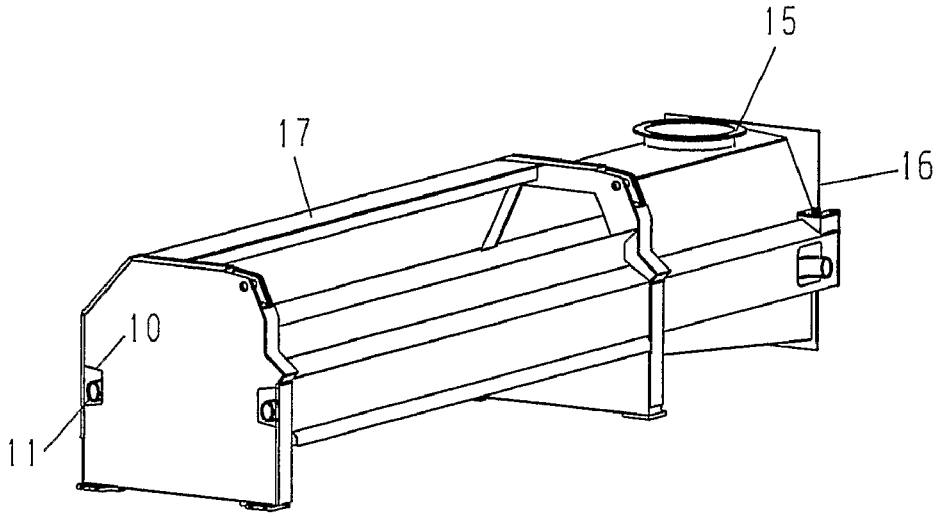
Figure 3:
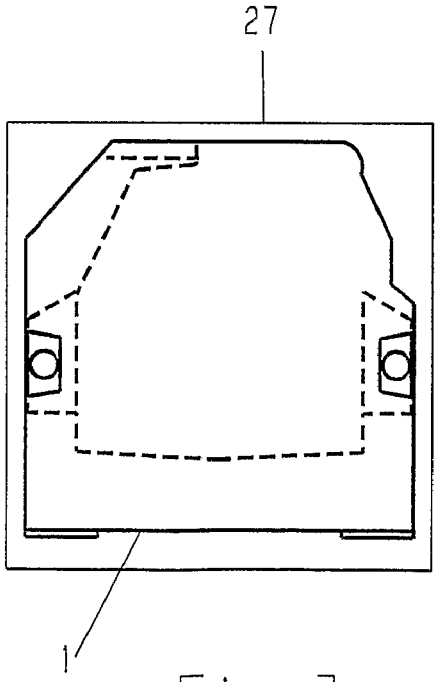
Figure 4A:
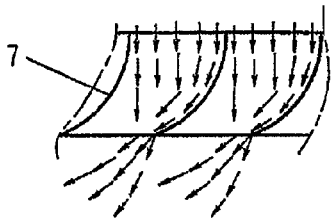
Figure 4:
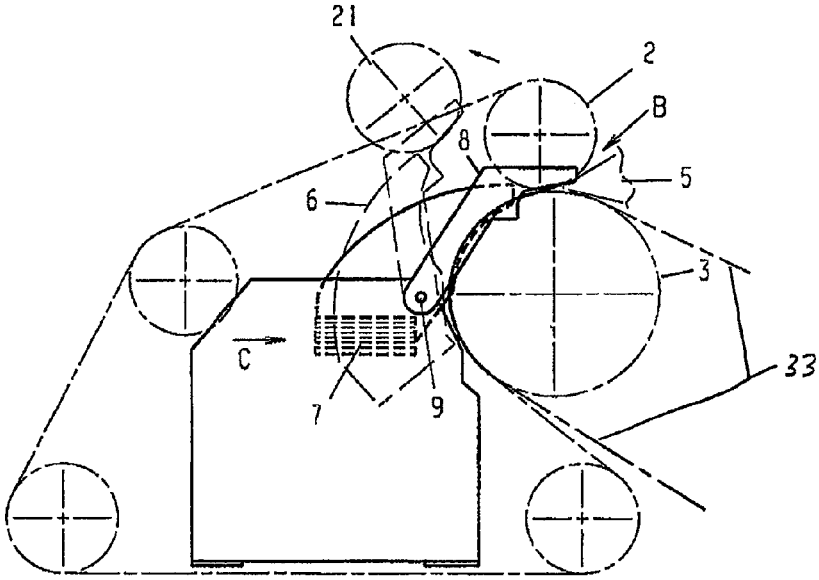
Figure 6:
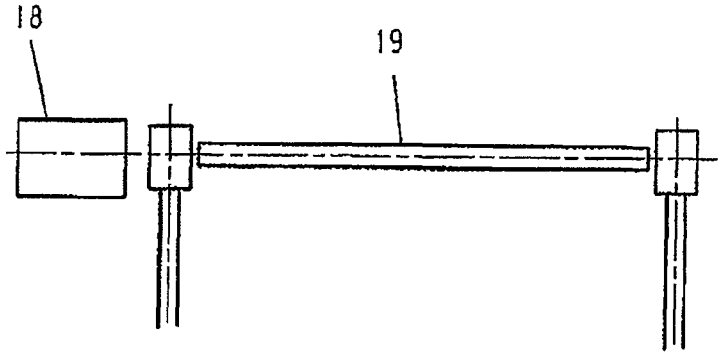
Figure 5:
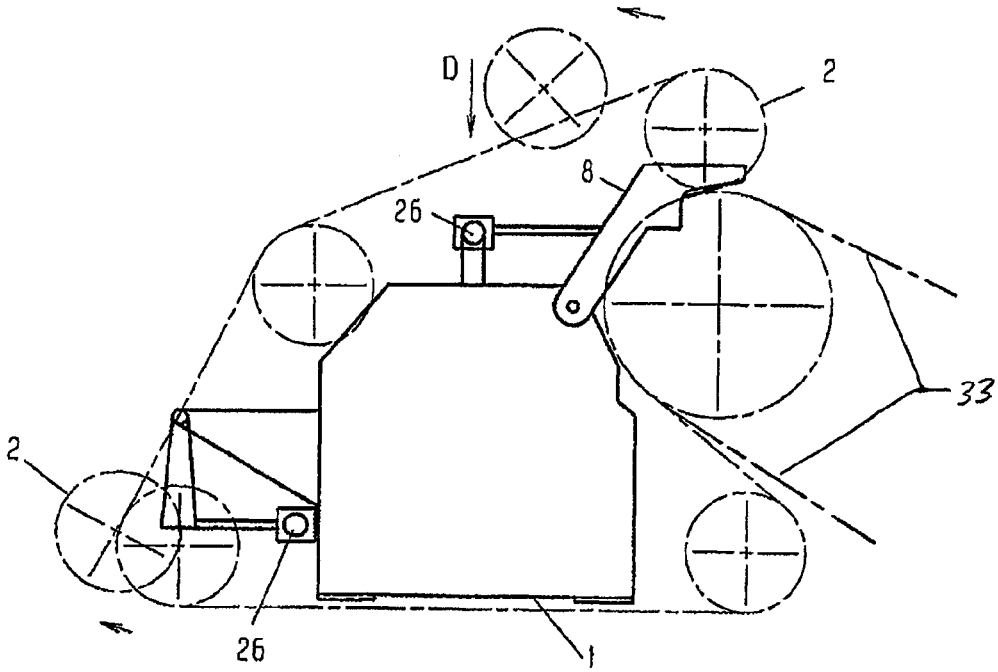
Figure 7:
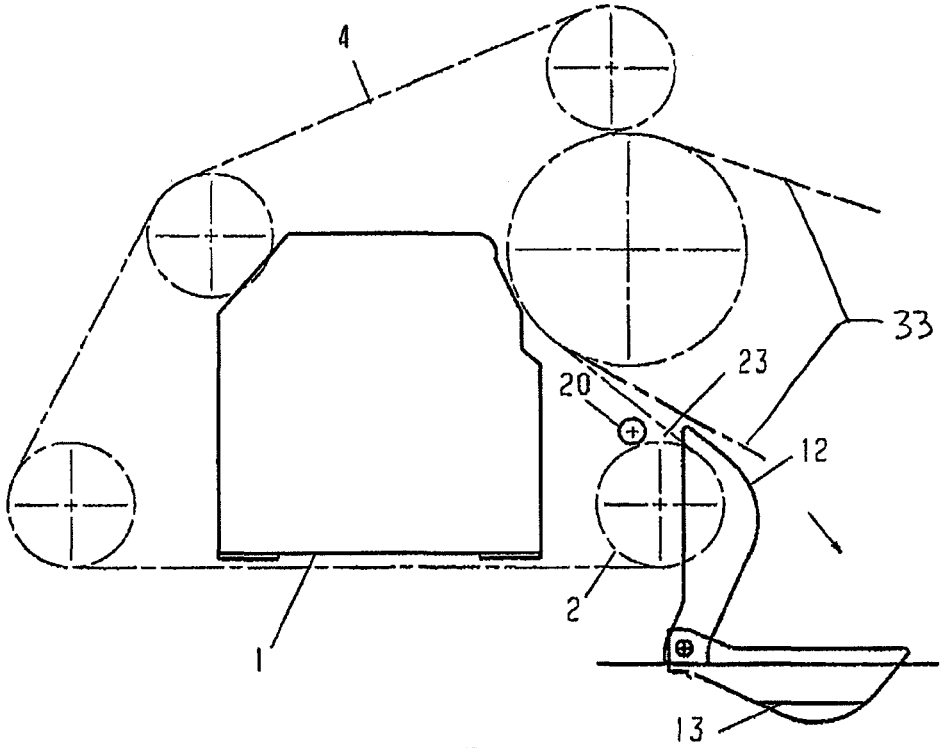
Figure 8:
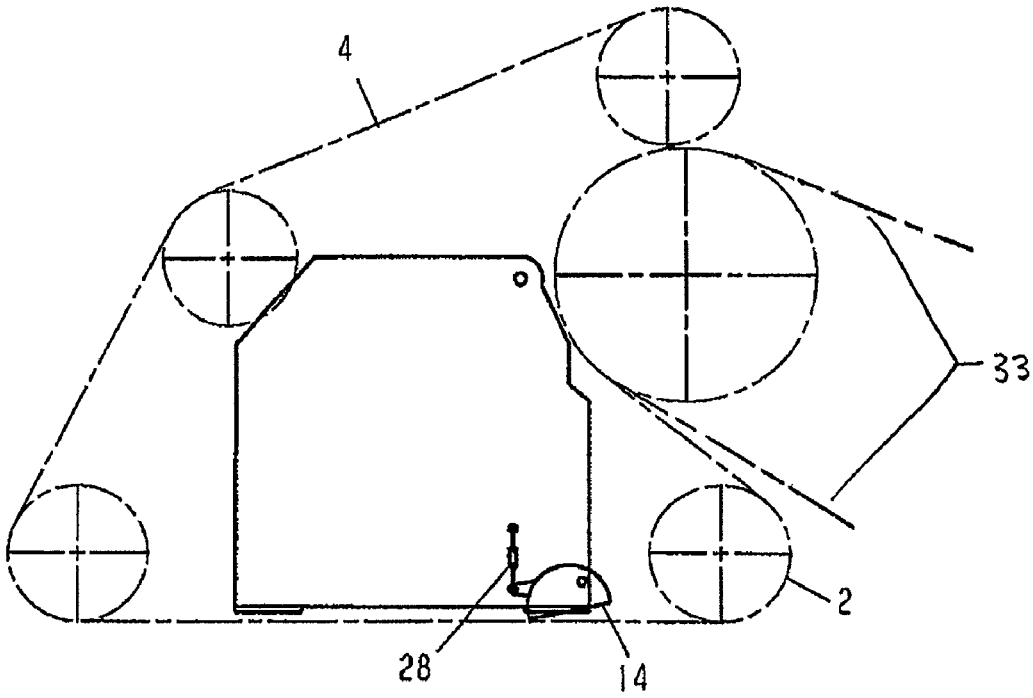
Figure 9A:
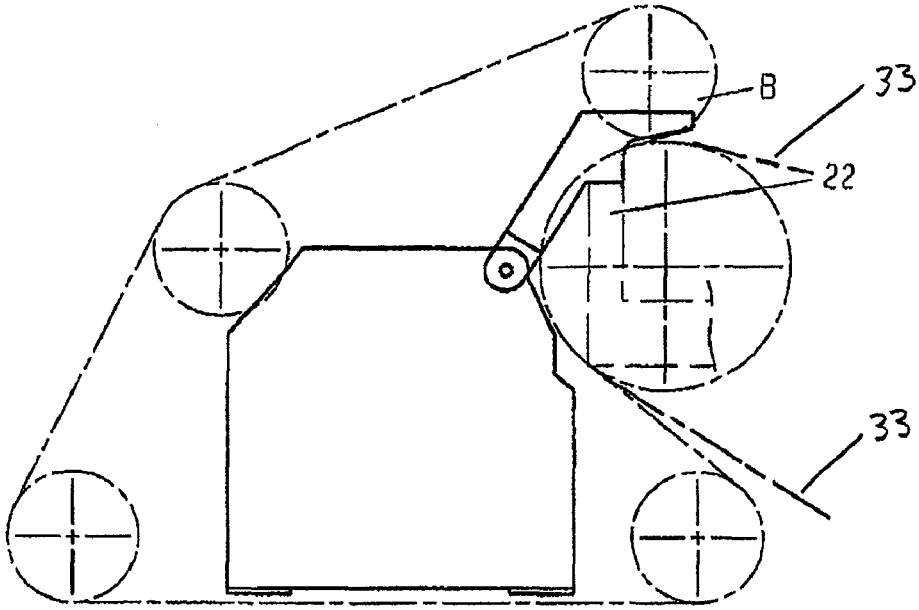
Figure 9B:
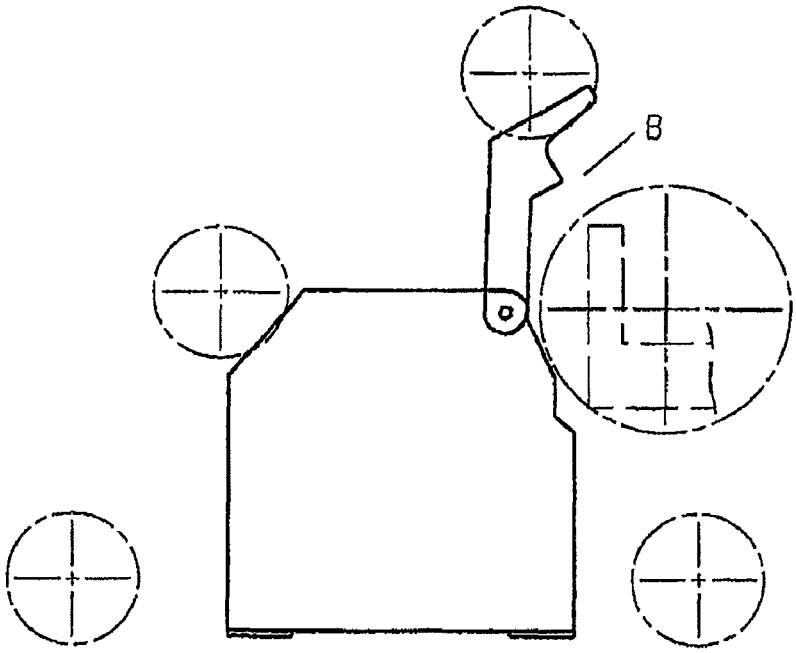
Figure 10:
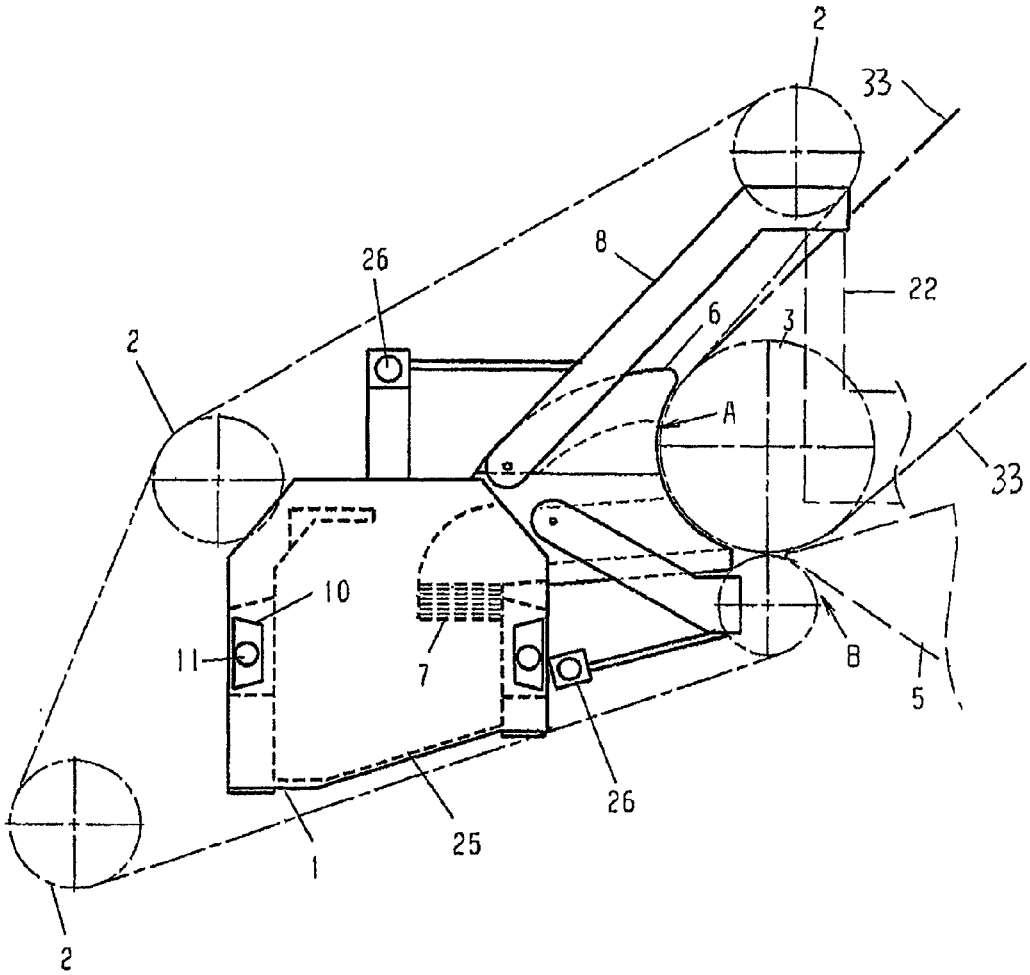

The unit and the forming section of the papermaking machine according to the invention will now be described more detailed with reference to the attached drawings:

FIG. 1 is a cross sectional view of a unit according to one embodiment of the invention for the Crescent-former type forming section FIG. 2 is a three dimensional view of the unit of FIG. 1 showing the pre-piping beams, cross going walkways, mist- and outlet connections FIG. 3 is a sectional view of the unit of FIG. 1 comparing to the container size FIG. 4 is a cross sectional view of the compact unit FIG. 4A is a view along the arrow C shows turning vanes guiding the drained water out of the forming area into the save-all tray FIG. 5 is a cross sectional view showing the rolls adjustment FIG. 6 is a schematic enlarged view in direction of arrow D in FIG. 5 of a roll retraction device with an electrical motor FIG. 7 is a cross sectional view showing a splash shield with an integrated cross walkway FIG. 8 is a view illustrating position of an adjustable mist- and water deflector FIGS. 9A, 9B are illustrating the securing of the unit by the arms to the machine frame during machine operation and a position for a wire change FIG. 10 is an alternative embodiment of a unit with an integrated save-all tray and stationary vanes for directing water from the forming area into the save-all tray in a C-former type of the forming section.

DETAILED DESCRIPTION OF THE PREFERRED EMBODIMENTS

The compact unit 1 for the Crescent-former type twin wire forming section in a paper making machine, for instance in a tissue paper making machine, the unit 1 according to the invention and as shown in FIG. 2 is pre-assembled and self-supporting. The unit 1, when delivered to the site, is ready to be mounted on a machine hall floor and does not require a special basement. As illustrated in FIG. 1, the unit 1 comprises an integrated save-all tray 25, which defines the unit 1 shape and dimensions. The unit 1 also has integrated pre-piping beams 10, in which all cross going pipes 11, necessary for the machine operation, are to be situated and also comprises integrated cross walkways 13, 17 provided for the service personnel as illustrated in FIG. 1 and FIG. 7. A number of rolls 2 are mounted to the compact unit 1 in the known way and provided with a roll retraction device 26 for a possible adjustment of the guiding rolls 2 position or stretching of the forming outer clothing 4 in the known manner.

As known in the art, in the twin wire forming section of the paper making machine a paper fibre stock is injected by a headbox 5 in a forming gap B between the two clothing, one forming outer wire 4 and one forming inner felt 33 in this particular embodiment, running together and merging in a forming zone A about a forming roll 3. The forming roll 3 is mounted onto the machine frame 22 and supports the inner forming felt 33. A forming zone tray 6 collects the water drained through the outer wire 4 in the forming zone A and directs it into the save-all tray 25 by vanes 7 as shown in FIG. 4A. The forming zone tray 6 is swingable as it is attached between the arms 8, which are rotatably about the axis 9 mounted onto the unit 1. The tray 6 comprises a number of deflecting vanes 7 being mounted in the swingable zone tray 6 for directing the drained water. The usage of the deflecting vanes 7 provides a higher velocity of the evacuated water, and therefore this design allows the size of the save-all tray 25 integrated into the unit 1 to be decreased comparing to the conventional save-all tray dimension. Simultaneous rotation of the forming zone tray 6 together with the arms 8 permits easier opening of the forming gap B between the outer forming wire 4 and the inner forming felt 33 for providing the change of the wire or other services, if required.

The pre-piping beams 10 are also integrated into the unit 1 for situating the cross going necessary pipes 11 within it, which arrangement allows for a more compact design of the forming section, improves the pipe 11 protection and provides a cleaner design, which is easier to keep clean. The unit 1 is provided also with an adjustable mist- and water deflector 14 for treating the outer wire 4 and depleting the wire 4 from the water on the return run to the forming zone A. The unit 1 is completed with a swingable splash shield 12 which is provided with a cross walkway 13 (not shown here) situated on its inner side and used only when the shield 12 is not in a working up-right position, as illustrated in FIG. 1, but is folded down about the axis 21 for service as shown in FIG. 7. The shield 12 might be mounted separately to the floor, to the machine basement or to the unit 1. During the machine operation, the shield 12 might be connected to some parts of the unit 1 in order to secure the working up-right position. When the paper machine is to be started, in order to ensure the relative position of the machine sections during the machine operation, the unit 1 should be connected to the other paper machine sections. The arms 8 mounted to the unit 1 are folded down and attached to the entire machine frame 22 (shown here in a dash line) by screws. The rotating rolls 2 causing the major vibrations are carried and supported by the separately situated unit 1 and not by the machine frame 22 itself, and therefore the entire frame 22 vibration is decreased while the arms 8 are able to transfer only minor vibrations from the unit 1 to the frame 22.

As illustrated in FIG. 2, in a three-dimensional view of unit 1, a cross going walkway 17 is also integrated into the unit 1. A mist connection 15 and an outlet connection 16 are arranged on a drive side of the unit 1.

FIG. 3 illustrates a cross section of the unit 1 and how the unit 1 is fitted into a standard transport container 27.

FIG. 4 illustrates the unit 1 according to the invention for the Crescent-former type forming section. For threading the clothing onto the rolls 2 or the change of the outer wire 4, the forming gap B should be opened, and this is achieved by moving the roll 2 in a direction of arrow into a position of roll 2' shown in the dash lines. The arms 8 are rotated about the axis 9 in the same direction, and the forming tray 6 moves in the position shown in a dash line. A special profile of the vanes 7, directing the drained water from the tray 6 into the save-all tray 25, serves a faster evacuation of the water drained into the forming zone A into the tray 25 and away from the forming unit 1 and thus allows decreasing of the tray 25 size, a possibility to integrate it within the self-supporting unit 1 eliminating in this way the massive machine frame part in the forming section and minimizing of the entire forming section foot print.

As mentioned earlier, the rolls 2 are mounted onto the unit 1 instead of being mounted onto the entire machine frame 22 and are provided with the roll retraction devices 26 as illustrated in FIG. 5. These roll retraction devices 26 allow moving of the rolls 2, when the forming gap B is to be opened for change of the wire 4 or for stretching the outer wire 4 in order to achieve the desired wire 4 tension.

The roll retraction device 26 is more detailed illustrated in FIG. 6, the view seen in the direction of arrow D in FIG. 5. The roll retraction device 26 comprises at least one electrical motor 18 and a composite shaft 19.

The usage of the composite shafts 19 instead of conventional steel shafts minimizes vibrations due to its lighter weight. As the composite shafts 19 have lighter weight, they do not require the massive frame to be mounted thereon, they could be mounted onto the unit 1 without increased dimensions of the unit 1. The use of the light-weight shafts 19 in the design allows fully use advantages provided by the higher speed electrical motors 18 as these shafts 19 have much lower inertia, and each start and stop of the motor 18 transfers faster to the corresponding roll 2 and thus to the wire 4, which in its turn improves the control of the wire 4 run.

The design of the unit 1 according to the invention avoiding hydraulic control devices is more environmental friendly, less expensive and more maintenance friendly, decreasing an amount of man-working hours.

In FIG. 7, the swingable splash shield 12 for use together with the unit 1 is shown in an upright working position and in a folded down non-working position. As known in the art, when the paper web is formed into the forming zone A and carried further to the next section by the inner fabric or the wire (not shown), the outer clothing or the wire 4 should be cleaned from the impurities prior to arriving to the forming zone A. In the self-supporting unit 1 between the wire 4 and the roll 2 there is a flooded nip 23 formed by a wire cleaning shower 20 or the similar known in the art device cleaning the wire 4 from the inside. In order to prevent spreading of the cleaning water into the machine room, the splash shield 12 is mounted adjacent to the flooded nip 23 position and catches the cleaning water penetrating the wire 4 during the machine operation. When the machine is stopped for some reason (for the service, clothing change or the like), the splash shield 12 is folded down for easier assess to all unit's 1 elements and an extra cross walkway 13 mounted on the bottom of the splash shield 12 is being available. The cleaning water is removed from the wire 4 by an adjustable mist- and water deflector 14 as shown in FIG. 8, which is mounted onto the unit 1. The position of the deflector 14 relative to the wire 4 can be adjusted even during the machine operation by a manually controlled screw 28 in order to achieve the best water depleting effect for the wire 4. The deflector 14 is connected to a machine ventilation system for the evacuation of water and mist from the wire 4.

When the machine is operated, the forming section including the self-supporting unit 1 should be connected to the rest of the papermaking machine. In the invention, the unit 1 is fixed to the machine frame 22 supporting the forming roll 3 and other elements by the arms 8, and thus the forming gap B is closed as illustrated in FIG. 9A.

When the machine is to be served or the wire 4 is to be changed or removed, the arms 8 are disconnected from the frame 22 and rotated away, opening wider the forming gap B that allows removing/change the wire 4 or provide another required service in the position as shown in FIG. 9B.

FIG. 10 illustrates an alternative embodiment of the unit 1 adopted to a C-former in the twin wire forming section of the paper making machine, in which one clothing forms the outer wire, and the second clothing forms the inner fabric (not shown) and wherein the unit 1 is provided with an integrated save-all tray 25 and the stationary vanes 7 connected to a stationary forming tray 6 for directing water from the forming zone A into the integrated save-all tray 25. This embodiment differs from the shown in FIG. 1 only by the stationary forming zone tray 6, the stationary deflecting vanes 7 and the adjustment of the rolls 2 adjacent to the forming roll 3 by the roll retracting device 26, when the forming gap B is to be open.

It is to be understood that the scope of the invention is not limited by the illustrated drawings and should be interpreted within the scope of the attached Claims. Although specific terms are employed herein, they are used in a generic and descriptive sense only and not for purposes of limitation.

The invention claimed is:

1. A self-supporting unit for a forming section in a paper making machine, wherein the forming section comprises an outer clothing being supported by rolls and an inner clothing, the outer clothing and the inner clothing being arranged to run in endless loops about the rolls and form a forming zone therebetween about a forming roll; in which forming section a headbox is arranged to inject a paper stock between said two clothing in a forming gap in order to form a paper web in the forming zone due to drainage of water through at least one of the outer clothing and the inner clothing, said drained water being evacuated from the forming section by at least one tray, said self-supporting unit being arranged as a separate frame element for mounting the rolls supporting one of the clothings and the tray, wherein the tray is an integrated tray defining a shape and dimension of the unit, and wherein the rolls supporting at least one of the outer clothing and the inner clothing are mounted to and supported by the unit.

2. The unit according to claim 1, wherein the unit comprises arms, which are arranged to connect the unit as a separate frame element to a frame, which frame is arranged to support the forming roll.

3. The unit according to claim 1, wherein the unit comprises a second tray directing drained water from the forming zone into the first tray.

4. The unit according to claim 3, wherein the second tray is mounted movably relative to the first tray.

5. The unit according to claim 3, wherein the second tray comprises vanes for directing drained water into the first tray.

6. The unit according to claim 1, wherein the outer clothing is one of the wire and the fabric.

7. The unit according to claim 1, wherein at least one of said rolls is provided with a roll retraction device for adjusting of the roll position.

8. The unit according to claim 7, wherein the roll retraction device comprises an electrical motor and a composite shaft.

9. The unit according to claim 1, wherein the unit comprises an integrated cross walkway.

10. The unit according to claim 1, wherein the unit comprises at least one integrated piping beam for mounting pipes.

11. The unit according to claim 1, wherein the unit comprises an adjustable mist and water deflector for depleting the outer clothing of the water.

12. The unit according to claim 1, wherein the unit comprises a mist connection and an outlet connection situated outside of a width of the forming zone.

13. The unit according to claim 1, wherein the unit is completed with a swingable splash shield having an integrated cross walkway.

14. The unit according to claim 1, wherein the unit is dimensioned to fit into a standard transport container.

15. A forming section in a paper making machine comprising an inner forming clothing and an outer forming clothing each supported by a number of rolls and arranged in two endless loops forming a forming zone therebetween, in which forming section a headbox is injected a paper fiber stock in a gap between both forming clothing running together in the forming zone about a forming roll; the forming roll being supported by a machine frame; a paper web is formed by draining the water through at least one clothing in the forming zone, said drained water being evacuated from the forming section by at least one tray, wherein the forming section of the paper machine comprises at least one self-supporting unit with the integrated tray for evacuation of the drained water, which unit acts separate from the machine frame for supporting the tray, and wherein the number of rolls supporting at least one of the inner forming clothing and the outer forming clothing are mounted to and supported by the unit.

16. The forming section according to claim 15, wherein the forming clothing is a forming wire for partial dewatering of the paper web.

17. The forming section according to claim 15, wherein the self-supporting unit is compact and comprises pre-assembled elements, including the tray, piping beams, and the cross walkway.

18. The forming section according to claim 15, wherein the unit comprises the second tray, and the second tray comprises a number of vanes for directing the drained water from the forming zone into the first tray.

19. The forming section according to claim 18, wherein the second tray is attached between arms mounted onto the unit.

20. The forming section according to claim 15, wherein at least one of said rolls is provided with a roll retraction device comprising an electrical motor and a composite shaft.

21. The forming section according to claim 15, wherein the unit comprises a shower for cleaning the clothing in a flooded nip in the return run to the forming zone and a splash shield for protection of the machine room from cleaning water.

22. The forming section according to claim 21, wherein the shield is swingable and has an integrated cross walkway on its inner side.

23. The forming section according to claim 15, wherein during the machine operation the unit is connected to the frame by arms.

24. The forming section according to claim 15, wherein the self-supporting unit comprises an adjustable mist- and water deflector.

25. The forming section according to claim 15, wherein the unit comprises a mist connection and an outlet connection outside of a width of the forming zone.

* * * * *